United States Patent [19]

Viegas

[11] Patent Number: 4,583,377

[45] Date of Patent: Apr. 22, 1986

[54] REFRIGERANT SUCTION ACCUMULATOR, ESPECIALLY FOR TRANSPORT REFRIGERATION UNIT

[75] Inventor: Herman H. Viegas, Bloomington, Minn.

[73] Assignee: Thermo King Corporation, Minneapolis, Minn.

[21] Appl. No.: 613,831

[22] Filed: May 24, 1984

[51] Int. Cl.[4] ..... F25B 43/00

[52] U.S. Cl. ..... 62/503; 62/512

[58] Field of Search ..... 62/503, 509, 512

[56] References Cited

U.S. PATENT DOCUMENTS

| | | | |
|---|---|---|---|
| 1,746,406 | 2/1930 | Sawyer | 62/503 |
| 2,813,404 | 11/1957 | Hirsch | 62/115 |
| 3,412,571 | 11/1968 | Bolynn | 62/188 |
| 3,643,465 | 2/1972 | Bottum | 62/503 |
| 3,837,177 | 9/1974 | Rockwell et al. | 62/503 |
| 3,872,687 | 3/1975 | Bottum et al. | 62/243 |
| 4,008,581 | 2/1977 | Hudson, Jr. | 62/503 |
| 4,009,592 | 3/1977 | Morse | 62/471 |
| 4,041,728 | 8/1977 | Morse et al. | 62/471 |
| 4,106,307 | 8/1978 | Matsuda | 62/324 |
| 4,354,362 | 10/1982 | Schumacher et al. | 62/503 X |

*Primary Examiner*—William E. Wayner

*Attorney, Agent, or Firm*—E. C. Arenz

[57] ABSTRACT

A secondary chamber 40, 64 is provided in a refrigerant suction accumulator 24 to receive liquid refrigerant through return tube 22 from a refrigerant evaporator 20 and is provided with a drip hole 50, 72, to limit the level of refrigerant buildup in the sump 52 under operating conditions of a refrigeration unit in which large quantities of liquid refrigerant are returned to the accumulator.

3 Claims, 7 Drawing Figures

REFRIGERANT SUCTION ACCUMULATOR, ESPECIALLY FOR TRANSPORT REFRIGERATION UNIT

BACKGROUND OF THE INVENTION

This invention pertains to the art of refrigerant suction accumulators, and especially to a particular construction thereof which is eminently suited for use in a transport refrigeration system unit. For that reason, the accumulator of the invention will be described in such an environment, although it is considered that its use is not limited thereto.

As is well known to those versed in this art, a suction accumulator used in a vapor-compression refrigeration system is interposed between the refrigerant evaporator and refrigerant compressor and has a main purpose of preventing undue quantities of liquid refrigerant from returning to the compressor, while permitting the flow of vaporous refrigerant from the accumulator to the compressor. The typical general construction of a suction accumulator as currently used with transport refrigerations may be generally as shown in U.S. Pat. NO. 3,420,071. As there shown, a return tube from the evaporator delivers refrigerant to the accumulator casing interior upper portion in vapor form and, depending upon conditions, to some degree in liquid form. The liquid refrigerant is intended to drop to the bottom sump portion of the casing, while some vaporous refrigerant is admitted into one end of a U-shaped tube in the upper portion of the casing and flows therethrough to an outlet in the top of the casing and back to the compresor. The U-shaped tube has an oil pickup port in its bight portion which permits the introduction of oil in the liquid refrigerant into the U-shaped tube for return to the compressor. As typically used in a transport refrigeration system environment, the accumulator has a cap or other structure at the bottom into which warm water from the internal combustion engine is circulated to boil off liquid refrigerant if it is present in the sump.

As used in a transport refrigeration system, under certain operating conditions such as a changeover from a cooling mode to a heating, or defrost, mode, and in particular with the evaporator operating at a low temperature and a low ambient existing, a large amount of liquid is dumped into the accumulator. Sometimes this liquid cannot be boiled off fast enough by the heat from the engine water and starts filling up the lower part of the U-tube, thus choking off the cross sectional flow area for the vapor which is supposed to return through the tube to the compressor. This results in high vapor velocities, and hence more liquid is entrained in the vapor to the compressor. Also, as the vapor is boiled off, it causes violent agitation of the liquid in the sump, causing a foamy liquid-vapor mixture. The level of this foam can rise high enough to enter the U-tube directly at the top, thus compounding the liquid carryover to the compressor. Depending upon the conditions, the amount of liquid returning to the compressor is sometimes enough to cause liquid slugging and damage to the compressor parts, and even destruction of the compressor.

The aim of this invention is to provide a suction accumulator construction intended to significantly alleviate the problem of return of liquid refrigerant to the compressor under conditions such as detailed above, as well as under other conditions.

SUMMARY OF THE INVENTION

In accordance with the invention, a refrigerant return chamber separate from the sump of the accumulator is provided, and refrigerant returning to the accumulator is directed into this secondary chamber and is permitted to drip therefrom through a metering port to the sump. The refrigerant return tube from the evaporator has its outlet disposed to direct the returning refrigerant to the accumulator into the secondary chamber. By holding some of the liquid refrigerant in the secondary chamber under conditions of a heavy return of liquid refrigerant to the accumulator, the heating means for the sump of the accumulator has a better chance to drive off refrigerant in vaporous form which exits the accumulator through the conventional U-shaped tube and the problems alluded to heretofore under certain conditions are generally avoided.

DESCRIPTION OF THE PREFERRED EMBODIMENTS

Figure 1:
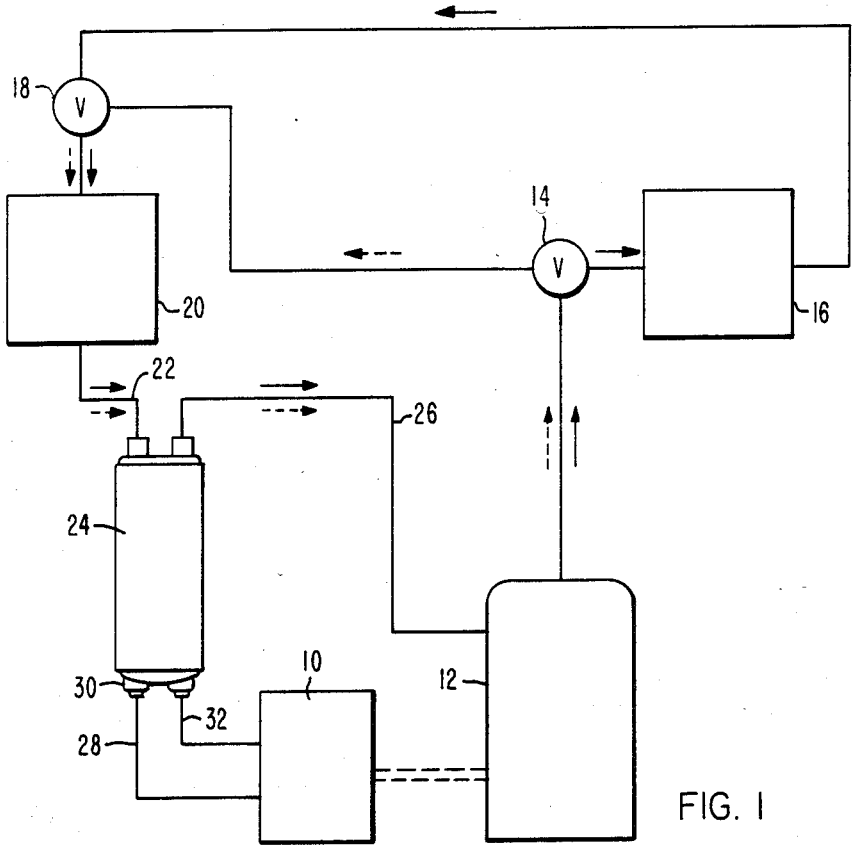
FIG. 1 is a schematic illustration of a transport refrigeration system of the type to which the accumulator of this invention is well suited for use.

In the schematically illustrated transport refrigeration system of FIG. 1, an internal combustion engine 10 drives a refrigerant compressor 12 which pumps hot gas to a three-way valve 14 which, if set in one position, delivers the hot gas to the refrigerant condenser 16. Liquid refrigerant is passed from condenser 16 to an expansion valve 18 at the inlet of refrigerant evaporator 20. Refrigerant from the evaporator passes through the evaporator return line 22 into the top of the accumulator 24. Mainly, vaporous refrigerant leaves the accumulator 24 and returns through line 26 to the compressor 12. Engine coolant water is passed through line 28 to the water jacket 30 at the bottom of the accumulator, this engine coolant returning through line 32 to the engine radiator (not shown) and to the engine 10. The description of the system thus far assumes the unit is in a cooling mode of operation. If the unit is shifted to a heating mode, or a defrost mode, the three-way valve 14 is shifted to an opposite position so that hot has from the compressor flows directly to the expansion valve 18. The direction of flow of the refrigerant in a cooling mode is indicated by the solid line arrows, while the direction of flow in a heating or defrosting mode is indicated by the dash line arrows. Not all elements included in an actual transport refrigeration system are shown in the FIG. 1 schematic illustration, but those omitted are considered to be of no significance with respect to the subject of this invention.

Figure 4:
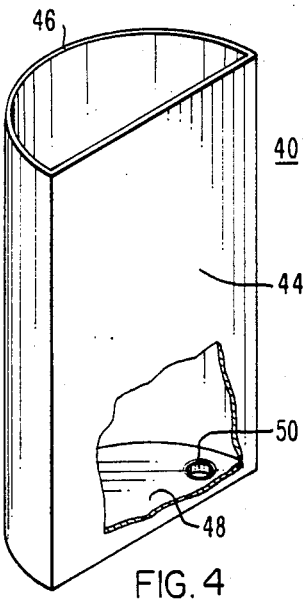
FIG. 4 is an isometric view of one form of secondary refrigerant return chamber as provided in the accumulator of FIGS. 2 and 3.
Figure 3:
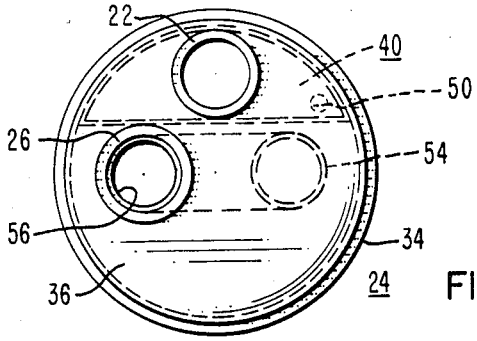
FIG. 3 is a top view of the accumulator of FIG. 2.
Figure 2:
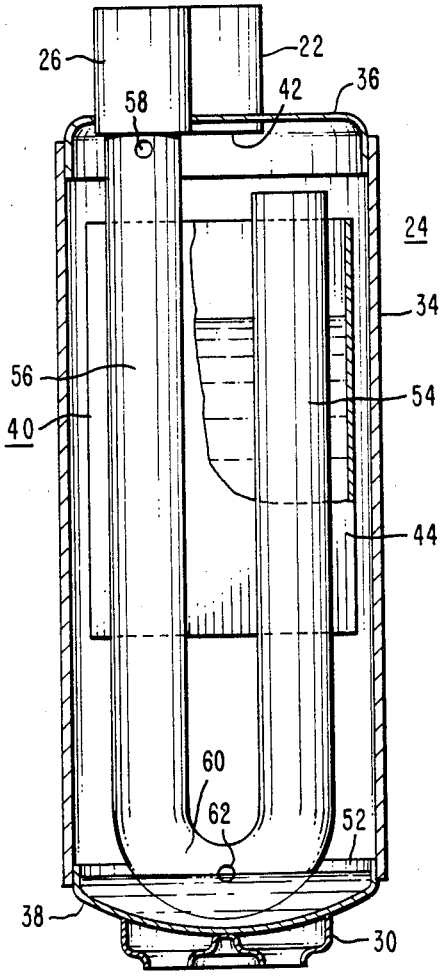
FIG. 2 is a partly broken, basically vertical cross-section of one form of accumulator according to the invention.

One form of accumulator in accordance with the invention is shown in FIGS. 2–4. The accumulator has a cylindrical casing 24 with a top wall 36 and a bottom wall 38. The return tube 22 from the evaporator delivers refrigerant into the upper interior space of the accumulator. In accordance with the invention, partition means are provided in the accumulator to form a secondary, or refrigerant return, chamber generally designated 40 which is upwardly open and is located in the casing so that the open outlet end 42 of the refrigerant return pipe is directly above the chamber.

In the form as shown in FIGS. 2–4, the chamber 40 includes a chordally-disposed wall 44, an arcuately disposed wall 46 and a bottom wall 48 which has a small drip port 50 therein. The chamber 40 is located within the casing so that the bottom wall 48 is elevated relative to the bottom space 52 in the casing, this space being referred to hereinafter as the sump.

The interior of the accumulator contains a U-shaped tube having one leg 54 open to the upper interior space of the accumulator, another leg 56 which projects out through the top wall 36 of the casing in sealed relation therewith, this leg including the usual vacuum breaker or anti-syphon hole 58 therein, and the bight 60 of the tube being located in the sump 52 and provided with a liquid return hole or port 62 as is usual with such tubes.

As is apparent from FIG. 3, the open end 42 of the refrigerant return tube 22 is offset, or out of alignment, with the open upper end of the one leg 54 of the U-tube. This is to minimize the direct introduction of the discharge from the return tube 22 into the U-tube. Liquid entrained in the refrigerant vapor entering the accumulator from the return tube 22 will drop into the open top of the secondary chamber and collect in the chamber while the vapor is free to exit the open top of this chamber and continue on to the compressor by way of the U-tube . In some instances, it may be desirable to provide a deflector at the open end 42 of the return tube 22 to deflect refrigerant toward that side of the casing which accommodates the secondary chamber 40. Typical liquid levels in the sump 52 and in the secondary chamber 40 under certain operating conditions providing significant liquid return to the accumulator are indicated by the liquid level lines in FIG. 2.

Figure 7:
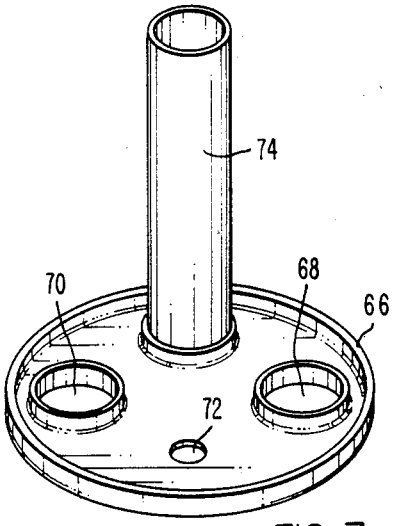
FIG. 7 is an isometric view of one form of plate means and tube for forming a part of the secondary chamber.
Figure 6:
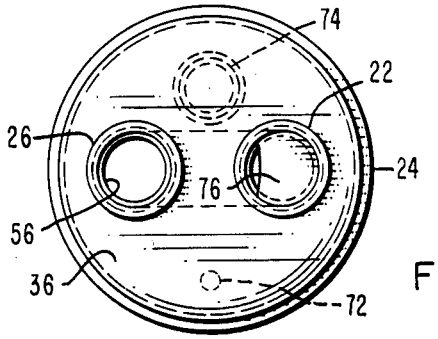
FIG. 6 is a top view of the accumulator of FIG. 5.
Figure 5:
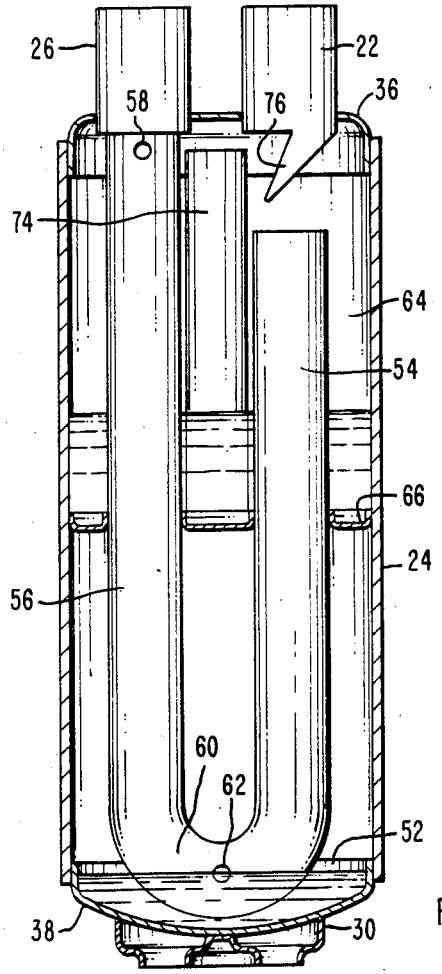
FIG. 5 is basically a vertical cross-section of an accumulator having another embodiment of the invention.

In another embodiment of the invention in an accumulator, as shown in FIGS. 5–7, the secondary chamber 64 occupies substantially the whole of the interior cross-sectional area of the accumulator at a level elevated from the sump 52. Those parts which are the same as in FIG. 2–4 are given identical numerals. A circular plate 66 is provided at an intermediate location and has holes 68 and 70 provided therein to accommodate the U-tube legs 54 and 56, respectively, and also has a drip hole 72 to meter liquid refrigerant and any oil contained therein as the liquid drips to the sump 52. The plate also carries a vapor tube 74 which projects upwardly from the plate with its open upper end located in the upper interior space of the accumulator. The tube 74 functions to permit vapor boiled off in the sump to rise into the upper interior space of the secondary chamber so that this vapor can pass into the open upper end of the one leg 54 of the U-tube. In the particular embodiment shown, the return tube 22 from the evaporator is directly above the upper open end of the leg 54 of the U-tube. For this reason, a deflector 76 may be provided at the end of the tube 22 to direct the refrigerant entering the accumulator away from that open upper end. Another way to minimize direct entry into the leg 54 would be to relocate the tube 22 to the quadrant of the top diametrically opposite the vapor tube 74 location.

With an accumulator according to the invention, the problem of too much liquid in the sump of the accumulator at any given time is avoided. This permits the heat available from the water jacket 30, relative to the quantity of liquid in the sump, to boil off the vapor. While some refrigerant liquid will typically be introduced into the U-tube through the oil return hole, it will not be sufficient to cause compressor problems when returned thereto. Also the lower liquid level in the sump attained with the invention significantly reduces the violent agitation and foaming possible with the conventional accumulators.

While the heat source for the sump has been described in terms of engine coolant, the heat could take other forms such as an electric heater, or heat from the engine exhaust. Also, while heat could be applied to the exterior of the secondary chambers, as currently contemplated the single heat source for the sump is considered adequate.

The prevention of a high liquid level in the sump provided by the accumulator according to the invention results in vapor moving through the U-tube without being severely restricted by liquid buildup in the bottom of the U-tube. The reduction in vapor pressure drop as the refrigerant passes through the accumulator will potentially increase the heating capacity of the unit as a whole. Further, the heating capacity of the unit will automatically be improved when less liquid refrigerant is carried over to the compressor.

I claim:

1. A refrigerant suction accumulator comprising:

a casing having a top wall, and a bottom wall forming the bottom of a liquid sump;

a generally U-shaped tube for carrying refrigerant and oil from said casing to a refrigerant compressor, said tube having one leg having an inlet end disposed in the upper interior space of said casing and its other leg projecting in sealed relation out of said casing, the bight of said tube being disposed in said bottom sump portion of said casing and including a liquid return port therein;

partition means in said casing separating a part of the interior into an upwardly open refrigerant return and holding chamber having its bottom elevated relative to said sump, said return chamber having drip port means in its lower portion of a size to meter liquid from said return chamber to said sump at a rate to limit build up of liquid in said sump and to temporarily hold liquid in said chamber under conditions during which large quantities of liquid refrigerant are returned to said casing;

return tube means for returning refrigerant from a refrigerant evaporator to said casing and having an outlet end in the upper portion of said casing and directed to discharge refrigerant into the space defined by said return and holding chamber, said outlet end further being disposed relative to said inlet end of said one leg of said U-shaped tube to substantially minimize direct return of liquid to said inlet end; and heat exchanger means associated with at least said bottom sump to vaporize liquid refrigerant therein.

2. An accumulator according to claim 1 wherein:

said partition means includes a generally chordally-disposed wall separating said return and holding chamber from the remaining interior of said casing, and said U-shaped tube is located in said remaining interior.

3. An accumular according to claim 1 wherein:

said partition means comprises plate means occupying substantially the interior cross section of said casing at a level elevated from said sump, said plate includes holes therein to accommodate the extension of said U-shaped tube legs therethrough; and an open vapor pipe projecting upwardly from said plate to said upper interior space of said casing to permit vapor from said sump to pass thereto.

* * * * *